US006041460A

United States Patent [19]

Cholewinski

[11] Patent Number: 6,041,460

[45] Date of Patent: Mar. 28, 2000

[54] BUCKET OPENER

[76] Inventor: Robert Cholewinski, 3336 S. Manor Dr., Lansing, Ill. 60438

[21] Appl. No.: 09/075,890

[22] Filed: May 11, 1998

[51] Int. Cl.[7] ..... B25F 1/00

[52] U.S. Cl. ..... 7/156; 7/151; 30/123

[58] Field of Search ..... 7/105, 166, 151, 7/156, 152; 81/3.07, 3.09, 3.55; 30/400, 123, 115

[56] References Cited

U.S. PATENT DOCUMENTS

| | | | |
|---|---|---|---|
| D. 276,585 | 12/1984 | DiFede | 7/151 |
| 3,299,449 | 1/1967 | Olney | 30/123 |
| 4,234,988 | 11/1980 | Ross et al. | 7/151 |
| 4,658,455 | 4/1987 | Skillern . | |
| 4,747,173 | 5/1988 | Marceau | 7/156 |
| 4,829,619 | 5/1989 | Edgerton | 7/156 |
| 4,967,436 | 11/1990 | Russell . | |
| 5,022,159 | 6/1991 | Cressman et al. | 30/400 |
| 5,069,090 | 12/1991 | Clark . | |
| 5,189,794 | 3/1993 | Kuo . | |
| 5,222,265 | 6/1993 | Hermansson . | |
| 5,228,159 | 7/1993 | Gurka . | |
| 5,241,719 | 9/1993 | Memmelaar . | |
| 5,476,023 | 12/1995 | Calandro . | |
| 5,778,472 | 7/1998 | Lang | 7/156 |

*Primary Examiner*—David A. Scherbel
*Assistant Examiner*—Joni B. Danganan
*Attorney, Agent, or Firm*—Bullwinkel Partners, Ltd.

[57] ABSTRACT

A tool for opening typical commercially available five gallon plastic buckets having a placement handle and placement end, cutting handle, cutting end, and a razor blade where the placement end is aligned with the bucket lid and the razor blade cuts through the plastic of the lid when pressure is applied to the handles.

4 Claims, 2 Drawing Sheets

BUCKET OPENER

BACKGROUND

1. Field of the Invention

The present invention relates to the field of hand tools and more specifically to a hand tool designed to open buckets or other similar containers with little effort.

2. Description of the Prior Art

Many commercial, industrial, and residential products are packaged in bucket type containers. For example, manufacturers often package products such as rubbing compound or roofing material in large, 5-gallon plastic buckets. Several devices exist for the removal of the lids of these containers.

For example, the Clark device, U.S. Pat. No. 5,069,090, the Skillern device, U.S. Pat. No. 4,658,455, and the Russell device, U.S. Pat. No. 4,967,436 all describe tools that open various types of buckets, including the 5-gallon plastic type. These devices apply pressure to the flange of the lid and pry it off the bucket, leaving the lid intact. However, while these types of devices allow the bucket lid to be re-used, they typically take a substantial amount of time to break the seal and remove the lid.

SUMMARY OF THE INVENTION

The present invention is a bucket opener designed to easily open five gallon plastic buckets containing roofing material, building materials, paint, or the like. The invention comprises a placement handle and a cutting handle connected by a pin. A razor blade and means for securing the razor blade are attached to the cutting end of the cutting handle. A prying lever and a placement section are attached to the placement end of the placement handle. To use the bucket opener, the placement section is positioned along the top of a bucket lid and pressure is applied to the handle. This pressure causes the cutting end to move towards the placement end, bringing the razor blade through the material of the bucket lid. The prying lever is used to remove the bucket lid after the lid is cut in several places.

The razor blade is secured within the cutting end through the securing means. The razor blade may be removed and replaced. The razor blade may be inserted into the cutting end in various positions, allowing adjustment of the amount of the razor blade that extends beyond the cutting end.

The placement end is designed to align the razor blade with the bucket lid so the lid will not bind in the bucket lid material when the tool is used.

The tool is preferably constructed of metal with rubber coverings for the placement handle and the cutting handle. Alternatively, the tool could be manufactured from a strong, high grade plastic.

DETAILED DESCRIPTION OF THE DRAWINGS

Figure 1:
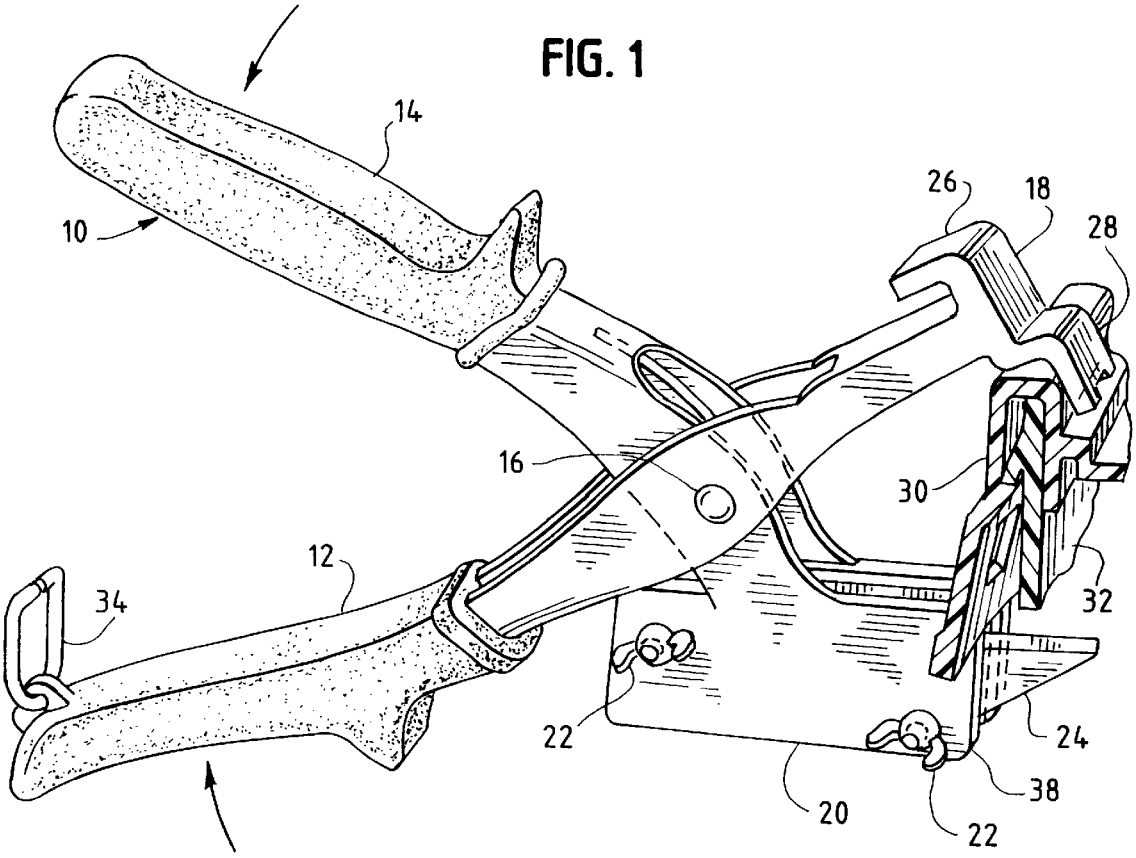
FIG. 1 is a perspective view of the tool constructed in accordance with the present invention, including a cut-out view of a bucket being opened.

In FIG. 1, the bucket opener 10 is shown properly positioned on a bucket lid 30 which is attached to a bucket 32. The bucket opener 10 comprises a placement handle 12, a placement end 18, a cutting handle 14, and a cutting end 20. The placement handle 12 and cutting handle 14 are pivotally connected by a pin 16.

The placement end 18 comprises a prying lever 26 and placement section 28. Preferably, the placement end 18 is attached to the placement handle 12 perpendicular to the axis of the placement handle 12. The prying lever 26 extends from the junction of the placement end 18 and the placement handle 12, bends approximately 90 degrees, and continues to extend back towards the placement handle 12. The placement section 28 extends substantially perpendicular to the axis of the placement handle 12, bends approximately 90 degrees to follow the axis of the placement handle 12 away from the pin 16 for a distance slightly larger than the typical width of the lid 30 of a commercial 5 gallon bucket, and makes another bend of approximately 90 degrees to travel perpendicular to the axis of the placement handle 12 towards the cutting end 20. It is easily seen in FIG. 1 that the placement end is designed to fit over the bucket lid 30 and form a secure platform from which to open the bucket.

The cutting end 20 comprises a mounting block 38, securing means 22, and a razor blade or other suitable cutting edge 24. The mounting block is most clearly shown in FIG. 6. FIG. 1 shows that the razor blade 24 is inserted into the mounting block 38 and secured with securing means 22. The preferred embodiment of the cutting end 20 uses wing nut and screw combinations for the securing means 22.

The invention is used in the following manner. The bucket opener 10 engages the bucket lid 30 by fitting the placement end 18 over the bucket lid 30. Pressure is than applied simultaneously to both the placement handle 12 and the cutting handle 14, forcing the razor blade 24 to cut through the bucket lid 30. When repeated a sufficient number of times at various locations around the lid 30, this procedure allows the seal between the bucket lid 30 and the bucket 32 to be broken. After the lid 30 is cut, the prying lever 26 is used to pry the lid 30 from the bucket 32, as explained below.

Figure 2:
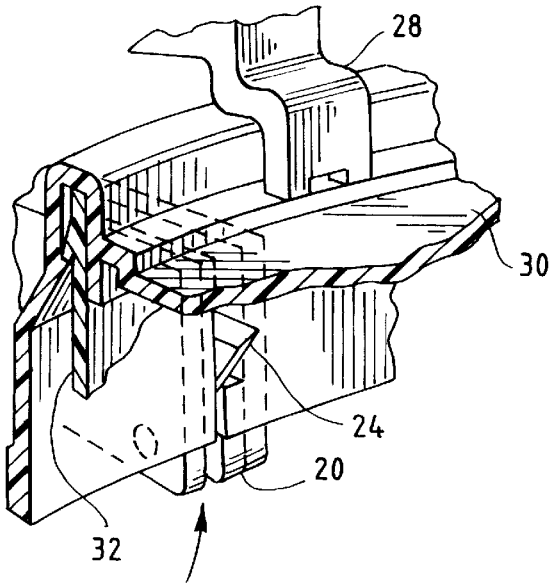
FIG. 2 is a cut-out view of the placement end and the cutting end mid-way through application of the tool to a bucket lid and bucket.

FIG. 2 shows the cutting process even more clearly, with the placement section 28 properly engaging the bucket lid 30. The razor blade 24, secured in the cutting end 20, is in motion and cutting through the bucket lid 30.

Figure 3:
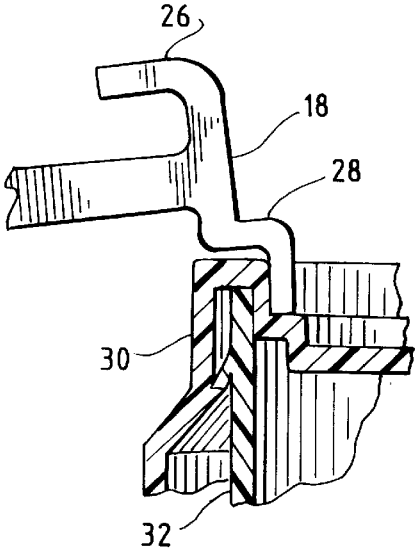
FIG. 3 is a side view of the placement end correctly positioned on a bucket lid sealed to a bucket.

FIG. 3 shows the proper position of the placement end 18 and the placement section 28 applied to a bucket lid 30 from a side view. It is easily seen from this figure how the placement section 28 fits over the bucket lid 30.

Figure 4:
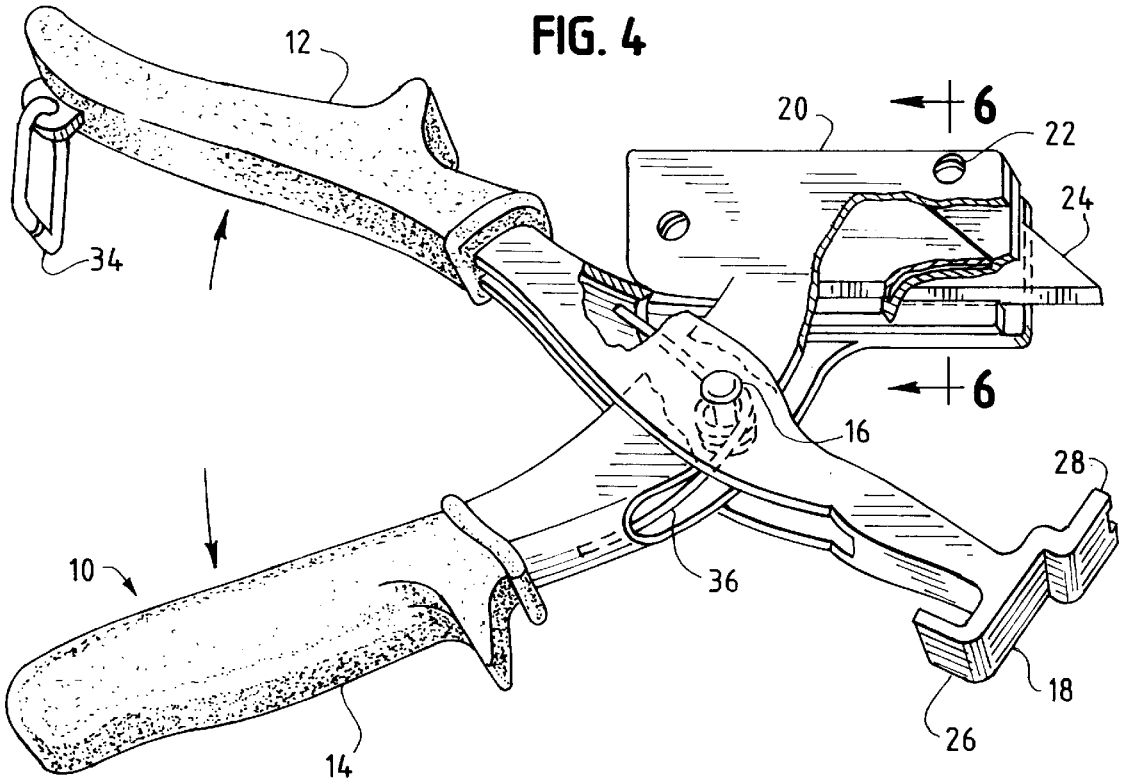
FIG. 4 is a perspective view of the tool constructed in accordance with the present invention, shown in partial cutaway.

FIG. 4 shows the bucket opener 10 with cutout views of the cutting end 20 and placement handle 12. FIG. 4 also shows a spring 36 wrapped around the pin 16 and extending down the placement handle 12 and the cutting handle 14. The preferred embodiment of the invention includes a latch 34 to store the tool with the placement handle 12 and the cutting handle 14 in a closed position, providing safe storage as the razor blade is protected by the placement end 18 when the handles are in the closed position. The spring 36 causes the bucket opener 10 to rest with the placement handle 12 and cutting handle 14 in the open position, allowing proper application to the bucket lid 30.

The cutting end 20 comprises a mounting block 38 and a razor blade 24. The mounting block consists of two brackets

Figure 6:
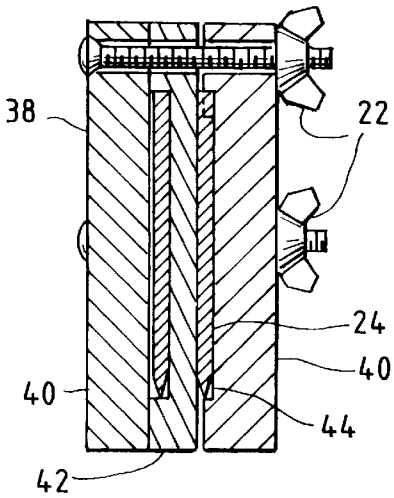
FIG. 6 is a cross-sectional view of the cutting end taken along line 6—6 of FIG. 4.

40 substantially parallel to each other and extending about 30 degrees from the axis of the cutting handle 14, a spacer 42, and securing means 22. FIG. 6, a cross section taken along line 6—6 of FIG. 4, most clearly shows the mounting block. The spacer 42 and razor blade 24 are placed between the brackets 40. The securing means holds the brackets 40, spacer 42, and razor blade 24 in proximity to each other and prevents any movement in relation to the other elements of this feature. In the preferred embodiment, one or both brackets 40 will include an inset 44 designed to accept the razor blade and provide a more positive placement within the mounting block 38. The preferred embodiment uses screws and wing nuts for the securing means 22, providing easy and quick replacement of the razor blade.

Figure 5:
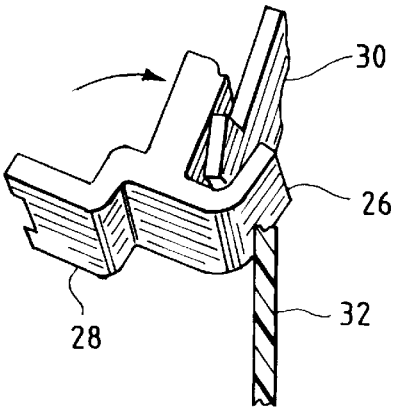
FIG. 5 is a perspective view of the prying lever of the placement end removing a bucket lid from a bucket.

After the lid 30 has been cut a sufficient number of times, the seal may be broken by the prying lever 26. FIG. 5 shows the placement section 28 in use to break the seal of bucket lid 30 from bucket 32 with the prying lever 26. The prying lever 26 is placed underneath the bucket lid 30 and rotated. The bucket opener 10 can be moved in either available direction after the prying lever 26 is inserted underneath the bucket lid 30. Moving the bucket opener 10 applies pressure to the prying lever 26 such that the seal between the bucket lid 30 and the bucket 32 is broken, and the lid lifts off of the bucket.

The foregoing description is for illustrative purposes only. Other modifications and alternative embodiments of the invention are contemplated which do not depart from the spirit and scope of the invention as defined by the foregoing description and appended claims. It is intended that the claims cover all such modifications that fall within their scope.

I claim:

1. A tool to remove a bucket lid from a bucket, said lid having a width, said tool comprising:

a placement handle having two ends and defining an axis along its length;

a cutting handle having two ends and pivotally connected to the placement handle by a pin;

a cutting end attached to one end of the cutting handle and comprising a cutting means; and a placement end attached to one end of the placement handle substantially perpendicular to the placement handle axis, said placement end and placement handle defining a junction at their area of attachment, said placement end comprising a placement section extending substantially perpendicular from said junction in a direction towards the cutting end, bending approximately 90 degrees and continuing in a direction away from the pin for a distance slightly greater than the width of the lid, then bending approximately 90 degrees and continuing in a direction towards the cutting end.

2. The tool according to claim 1 wherein:

the cutting handle defines an axis along its length, the cutting end and the cutting handle form a junction where they are attached; and the cutting means further comprises;

a razor blade;

two brackets disposed on either side of the razor blade substantially parallel to each other and extending approximately 30 degrees from the axis of the cutting handle;

a spacer inserted between the two brackets; and a securing means to hold the brackets, spacer and razor blade in fixed relationship to each other.

3. The tool according to claim 1 wherein the placement end further comprises a prying lever extending substantially perpendicular from said junction in a direction away from the cutting end, bending approximately 90 degrees and continuing in a direction towards the pin.

4. A tool to remove a bucket lid from a bucket, said tool comprising:

a placement handle having two ends;

a cutting handle having two ends and pivotally connected to the placement handle by a pin, said cutting handle defining an axis along its length;

a placement end connected to one end of the placement handle; and a cutting end connected to one end of the cutting handle and comprising a cutting means, said cutting means comprising a razor blade, two brackets on either side of the razor blade substantially parallel to each other extending approximately 30 degrees from the axis of the cutting handle, a spacer inserted between the two brackets, an inset held between the brackets to provide positive placement of the razor blade within the brackets, and means for holding the brackets, spacer, inset and razor blade in relation to one another.

* * * * *